United States Patent [19]

Leinfelt

[11] 4,184,225

[45] Jan. 22, 1980

[54] VACUUM CLEANER DUST BAG AND MOTOR DISCONNECT DEVICE

[75] Inventor: Karl E. Leinfelt, Stockholm, Sweden

[73] Assignee: Aktiebolaget Electrolux, Stockholm, Sweden

[21] Appl. No.: 924,642

[22] Filed: Jul. 14, 1978

Related U.S. Application Data

[63] Continuation-in-part of Ser. No. 840,420, Oct. 7, 1977, abandoned, and a continuation-in-part of Ser. No. 723,231, Sep. 15, 1976, abandoned.

[51] Int. Cl.[2] ..... A47L 9/28

[52] U.S. Cl. ..... 15/339

[58] Field of Search ..... 15/339, 412; 55/214, 55/DIG. 2, DIG. 34

[56] References Cited

U.S. PATENT DOCUMENTS

| | | | |
|---|---|---|---|
| 2,911,062 | 11/1959 | Ferraris | 55/214 X |
| 4,001,912 | 1/1977 | Eriksson | 15/339 |

*Primary Examiner*—Christopher K. Moore

*Attorney, Agent, or Firm*—Alfred E. Miller

[57] ABSTRACT

A vacuum cleaner in which the fan motor is rendered inoperative when there is no dust bag in the apparatus. The arrangement includes a servomotor having a pressure-responsive member, such as a diaphragm that operates a switch which, when closed upon the presence of a dust bag in the vacuum cleaner, permits electric current to be supplied to the fan motor. When no dust bag is present in the vacuum cleaner, the switch, which is responsive to the position of a diaphragm, will return to its original position whereby the electric current to the fan motor is disconnected.

5 Claims, 2 Drawing Figures

VACUUM CLEANER DUST BAG AND MOTOR DISCONNECT DEVICE

The present invention is a continuation-in-part of co-pending U.S. patent application Serial No. 723,231 filed on Sept. 15, 1976, and now abandoned, and co-pending U.S. patent application Serial No. 840,420 filed on Oct. 7, 1977, now abandoned.

BACKGROUND OF THE INVENTION

The present invention relates to a vacuum cleaner dust bag and a fan motor disconnect arrangement wherein said dust bag permits passage of air while a relatively rigid end plate thereof has an opening through which dust particles pass from the vacuum cleaner nozzle to the dust bag, and if the latter is not in place, the motor is rendered inoperative.

It is an object of the present invention to provide a push button that is controlled by a diaphragm that is responsive to the negative pressure in the control device and functions to operate the fan motor when a dust bag is in the vacuum cleaner and causing a negative pressure therein.

On the other hand, when no dust bag is present in the machine there is no negative pressure in the arrangement and the push button, when released, will return to its original position and disconnect the electric current to the fan motor.

In order that the invention will be more clearly understood, it will now be disclosed in greater detail with reference to the accompanying drawings, in which:

FIG. 1 is a perspective view of a dust bag for a vacuum cleaner showing a relatively rigid end plate having two flat parts that are superposed and glued together, all in accordance with the teachings of the present invention; and FIG. 2 is a partial sectional view of the motor disconnect device and vacuum cleaner dust bag as shown in FIG. 1.

DESCRIPTION OF THE PREFERRED EMBODIMENT

Figure 1:
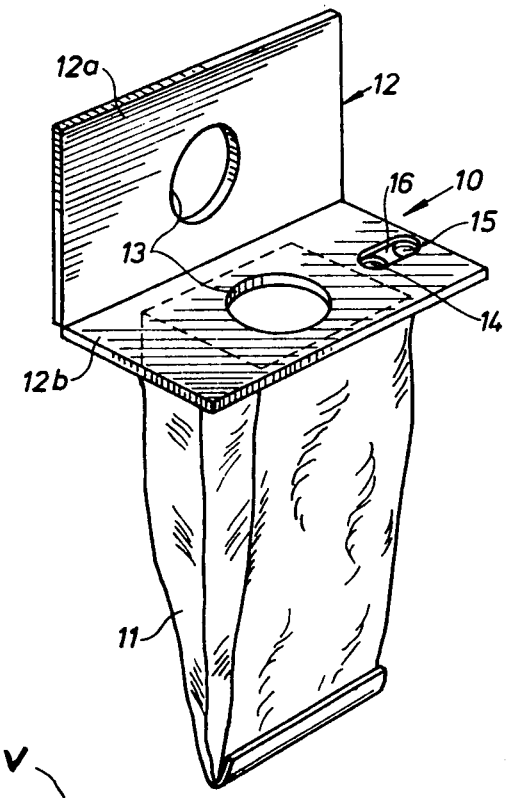
Figure 2:
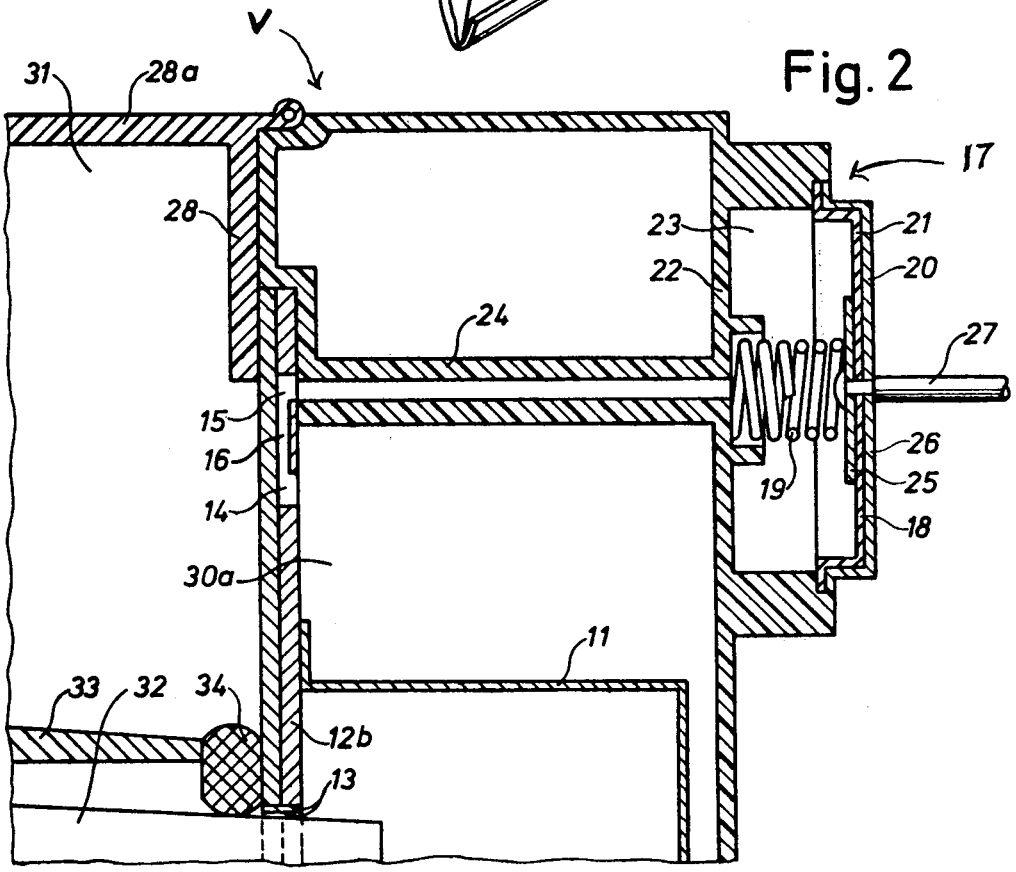

Referring to FIG. 1, a dust bag for a vacuum cleaner is shown and referred to generally by the numeral 10 and comprises a part 11 of pervious filter paper attached to an end plate 12 of relatively rigid material. The end plate, as shown in FIG. 1, consitutes two layers **12*a* and 12*b* which are glued together in a superposed manner, each layer having a through hole 13 which is aligned and through which dust drawn in by the vacuum cleaner nozzle (not shown) is conveyed into the bag 10. Laterally disposed from the through hole 13 the bottom layer 12*b* has two additional holes 14 and 15 which are connected by a groove 16 in such a manner that the flow path of air is formed between the two layers when glued together and the two openings of the flow path are situated on the underside of the end plate. This particular arrangement is clearly seen in FIG. 2**, of the drawings.

The vacuum cleaner V is provided with a device referred to generally by the numeral 17 as a servomotor having a diaphragm 18. The servomotor 17 is outside the portion of the vacuum cleaner which is under a vacuum, thus placing this device under atmospheric pressure. Normally, the diaphragm 18 is urged by a compression spring 19 against a wall 20 of a chamber 21 when the motor fan unit (not shown) is disconnected.

The diaphragm 18 is at one end of the chamber 21 and the other end constitutes a wall 22 which together with the diaphragm forms the space 23 which through a channel 24 communicates with the hole 15 of the dust bag 10. It will be observed that either side of the diaphragm 18 is provided with reinforcing plates 25 and 26. The latter reinforcement plate 26 is operatively connected with a rod 27 which in turn is connected to the electrical current switch of the vacuum cleaner (not shown). Consequently, when the bag 10 is in place in the vacuum cleaner and the end plate 12 is held in position by an extending part 28 of the vacuum cleaner end cover **28*a*, the hole 15 will be situated over the mouth of the channel 24 and the hole 14 communicates with a space 30*a*** having negative pressure in the vacuum cleaner.

The end cover 28 forms a cover chamber 31 communicating with the ambient so that atmospheric pressure always prevails in the chamber. The end cover 28 is provided with a tubular member 32 forming a continuation of the suction hose (not shown). The end of this member enters the opening 13 when the cover **28*a* is being closed. The member 32 is surrounded by a support 33 abutting a rubber seal 34, which is pressed against the collar 12 of the dust bag. Tne end cover 28*a* is swingably mounted on the vacuum cleaner by a hinge 35. When there is no dust bag in the vacuum cleaner ambient air of atmospheric pressure present in the chamber 31 will push through the channel 24 to the space 23, thereby keeping the diaphragm 18, with the aid of spring 19, pushed to the right against wall 20. Thus, the pressure drop induced in chamber 31 and space 30*a* which are joined together when the bag 11 with its end plate 12 is absent from the vacuum cleaner housing is insufficient to overcome the bias of spring 19 to move the diaphragm 18 in a leftward direction. Furthermore, even if the vacuum cleaner fan unit is turned on and generates low negative pressure, this pressure will not be sufficient to influence the total pressure in chamber 31 and space 30*a* to overcome the force of spring 19 urging the diaphragm 18 to its position to the right in FIG. 2**.

It should be pointed out that when the dust bag 10 is present in the apparatus and the vacuum cleaner is started and is operative, a negative pressure is generated behind the dust bag 10. This negative pressure is transferred by means of the hole 14, the groove 16 and the channel 24 to the space 23 so that the diaphragm is moved leftwardly against the action of the spring 19. Consequently, the rod 27 follows the movement of the diaphragm and moves in a linear direction to either supply or cut off the current supply to the vacuum cleaner motor-fan unit by any well-known means, such as a microswitch (not shown).

If there is no dust bag 10 in the vacuum cleaner V when the motor is started, atmospheric pressure prevailing in the cover chamber 31 will be transmitted through the channel 24 to the space 23 as stated hereinbefore. Thus, the negative pressure created by the motor will have no greater influence on the total pressure in the chamber 31 and space **30*a***. When the switch is released, it will return to its inactive position and switch off the electric current to the motor-fan unit.

The present construction is relatively simple and functions reliably to indicate to the user of the vacuum cleaner whether or not a dust bag is present in the apparatus.

What is claimed is:

1. The combination of a vacuum cleaner having a dust receptacle and a motor disconnect device for a vacuum cleaner motor, a conduit and an enclosure, comprising: an air-pervious bag-like part of said dust receptacle provided with an end plate of relatively rigid material, said end plate having an opening through which dust particles are drawn by said vacuum cleaner and into said bag-like part, and said end plate being provided with spaced openings and a connecting channel which together with said conduit and enclosure forms a flow path for air that creates a vacuum in said enclosure when said motor is in operative condition, said channel extending at least partly in the plane of said end plate and said vacuum in said enclosure acting on said motor disconnect device to maintain said motor in an operative condition when said dust receptacle is in place in said vacuum cleaner and to disconnect said motor from a power source when said dust receptacle is not in place in said vacuum cleaner and atmospheric air is present in said enclosure.

2. In the combination as claimed in claim 1 wherein said end plate comprises two superposed layers and forming said flow path therebetween.

3. In the combination as claimed in claim 2 wherein one of the layers of said end plate is positioned adjacent to the interior of said bag-like part, and said spaced openings being two through holes in said one layer located laterally with respect to said bag-like part, said channel being a groove in at least one of said layers connecting said through holes which together form said flow path.

4. In the combination as claimed in claim 3 wherein said groove is formed by a recess in both of said layers.

5. In the combination as claimed in claim 2 wherein one of the layers of said end plate is positioned adjacent to the interior of said bag-like part, said spaced openings being two through holes in said one layer located laterally with respect to said bag-like part, a part of said upper layer being of an inverted cup-shape which is affixed over said through holes in the bottom plate to form said flow path.

* * * * *